US009498992B2

(12) United States Patent
Nishio et al.

(10) Patent No.: US 9,498,992 B2
(45) Date of Patent: Nov. 22, 2016

(54) SHEET MATERIAL COOLING DEVICE AND PRINTER INCLUDING THE SAME

(71) Applicant: Panasonic Intellectual Property Management Co., Ltd., Osaka (JP)

(72) Inventors: Tetsuya Nishio, Fukuoka (JP); Takafumi Shingai, Kumamoto (JP); Katsushi Nakao, Kumamoto (JP); Eiji Okuzono, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/945,423

(22) Filed: Nov. 18, 2015

(65) Prior Publication Data

US 2016/0159122 A1 Jun. 9, 2016

(30) Foreign Application Priority Data

Dec. 9, 2014 (JP) ..... 2014-248596
Jun. 15, 2015 (JP) ..... 2015-120507

(51) Int. Cl.
*B41J 29/377* (2006.01)
*B41J 11/00* (2006.01)
*B41F 23/04* (2006.01)

(52) U.S. Cl.
CPC ..... *B41J 29/377* (2013.01); *B41F 23/0479* (2013.01); *B41J 11/0015* (2013.01)

(58) Field of Classification Search
CPC ..... B41F 23/0476; B41F 23/0479; B41F 23/0483; B41F 23/04; B41F 29/377; B41F 11/0015
See application file for complete search history.

(56) References Cited

U.S. PATENT DOCUMENTS 3,775,203 A * 11/1973 Johnson ..... B29C 65/18 101/6
4,913,224 A * 4/1990 Moran ..... B41F 23/0479 165/89
5,532,807 A * 7/1996 Takemoto ..... G03G 15/2053 219/216
6,220,161 B1 * 4/2001 De Vroome ..... B41F 23/0479 101/416.1
6,328,529 B1 * 12/2001 Yamaguchi ..... F04D 25/08 257/E23.086
6,388,692 B1 * 5/2002 Iwata ..... B29C 66/0042 156/349
6,675,876 B2 * 1/2004 Yamashita ..... B29C 33/044 165/89
2003/0228180 A1 * 12/2003 Mitsuya ..... G03G 21/203 399/341
2006/0210333 A1 * 9/2006 Kakishima ..... G03G 15/6573 399/341
2008/0124111 A1 * 5/2008 Baba ..... G03G 15/2039 399/69
2008/0298862 A1 * 12/2008 Shinshi ..... G03G 15/2064 399/324
2011/0052258 A1 * 3/2011 Kamoshida ..... G03G 15/2053 399/122
2015/0054894 A1 * 2/2015 Kikugawa ..... B41J 11/002 347/102

FOREIGN PATENT DOCUMENTS

JP 5-301336 11/1993

* cited by examiner

*Primary Examiner* — David Banh
(74) *Attorney, Agent, or Firm* — McDermott Will & Emery LLP

(57) ABSTRACT

A sheet material cooling device includes a cylindrical body having an outer circumferential surface to be in contact with a sheet material, a cooling unit having a cooling surface in contact with an inner circumferential surface of the cylindrical body, and a first fastening member inserted from an outside of the cylindrical body toward an inside to attach the cooling unit to the cylindrical body in a state that the cooling surface is in contact with the inner circumferential surface.

12 Claims, 9 Drawing Sheets

SHEET MATERIAL COOLING DEVICE AND PRINTER INCLUDING THE SAME

BACKGROUND

1. Field of the Invention

The present disclosure relates to a sheet material cooling device provided within a sheet material conveyance step, and a printer including the sheet material cooling device, and more particularly to a sheet material cooling device which cools a sheet material during conveyance of the sheet material, and a printer including the sheet material cooling device.

2. Description of the Related Art

In duplex printing conventionally performed by an industrial printer or the like, a printing sheet is temporarily dried by using an ink drying device (hereinafter referred to as drier) after front surface printing. This drying process is executed to dry ink prior to rear surface printing after the front surface printing is completed. The drier heats and dries the printing sheet at a high temperature (approximately 80° C., for example). In duplex printing, the rear surface printing is performed after the front surface printing. When the temperature of the printing sheet is high at the time of rear surface printing, printing becomes unstable. Accordingly, the printing sheet needs to be cooled to an appropriate temperature for stable printing (approximately 40° C., for example) before the rear surface printing starts.

There is a type of industrial printer which includes a sheet material cooling device. This sheet material cooling device conveys a printing sheet from a front surface printing device for printing on a front surface of the printing sheet, to a rear surface printing device for subsequent printing on a rear surface of the printing sheet. The sheet material cooling device is disposed between the front surface printing device and the rear surface printing device, and includes a plurality of rollers. When the sheet material cooling device cools the printing sheet during conveyance of the printing sheet on the rollers, the temperature of the printing sheet lowers to an appropriate temperature before the start of the rear surface printing. Accordingly, a type of the sheet material cooling device is equipped with cooling units within the rollers (for example, see Unexamined Japanese Patent Publication No. 5-301336).

SUMMARY

A sheet material cooling device and a printer including the sheet material cooling device according to the present disclosure includes a cylindrical body having an outer circumferential surface to be in contact with a sheet material, a cooling unit having a cooling surface in contact with an inner circumferential surface of the cylindrical body, and a first fastening member inserted from an outside of the cylindrical body toward an inside to attach the cooling unit to the cylindrical body in a state that the cooling surface is in contact with the inner circumferential surface.

According to the present disclosure, the cooling surface of the cooling unit is easily brought into tight contact with the inner circumferential surface of the cylindrical body. Accordingly, cooling performance for a sheet material in contact with the outer circumferential surface of the cylindrical body improves.

Figure 4:
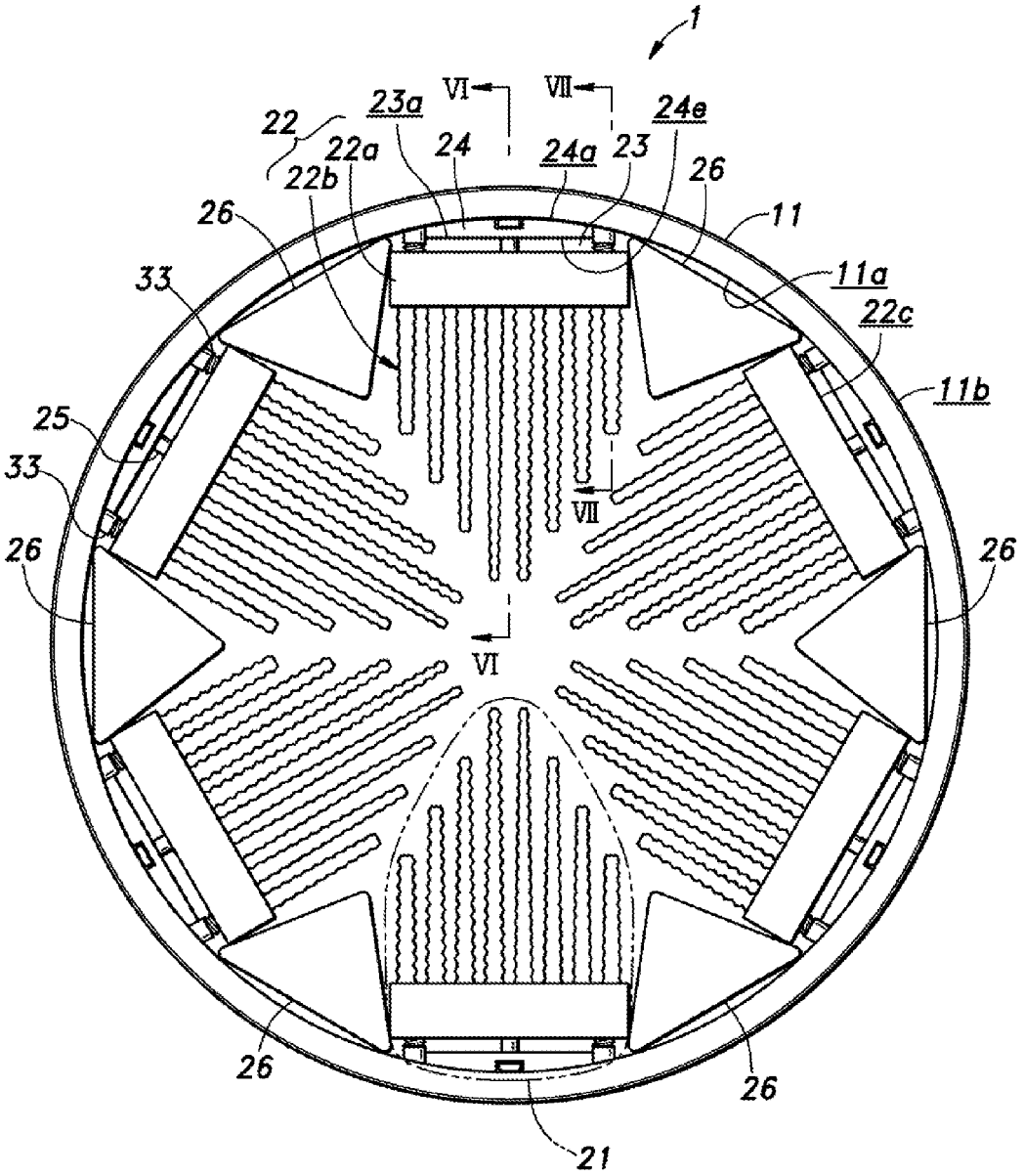
FIG. 4 is a view illustrating an internal structure at IV-IV line in FIG. 2 as viewed in a direction of arrows.
Figure 8:
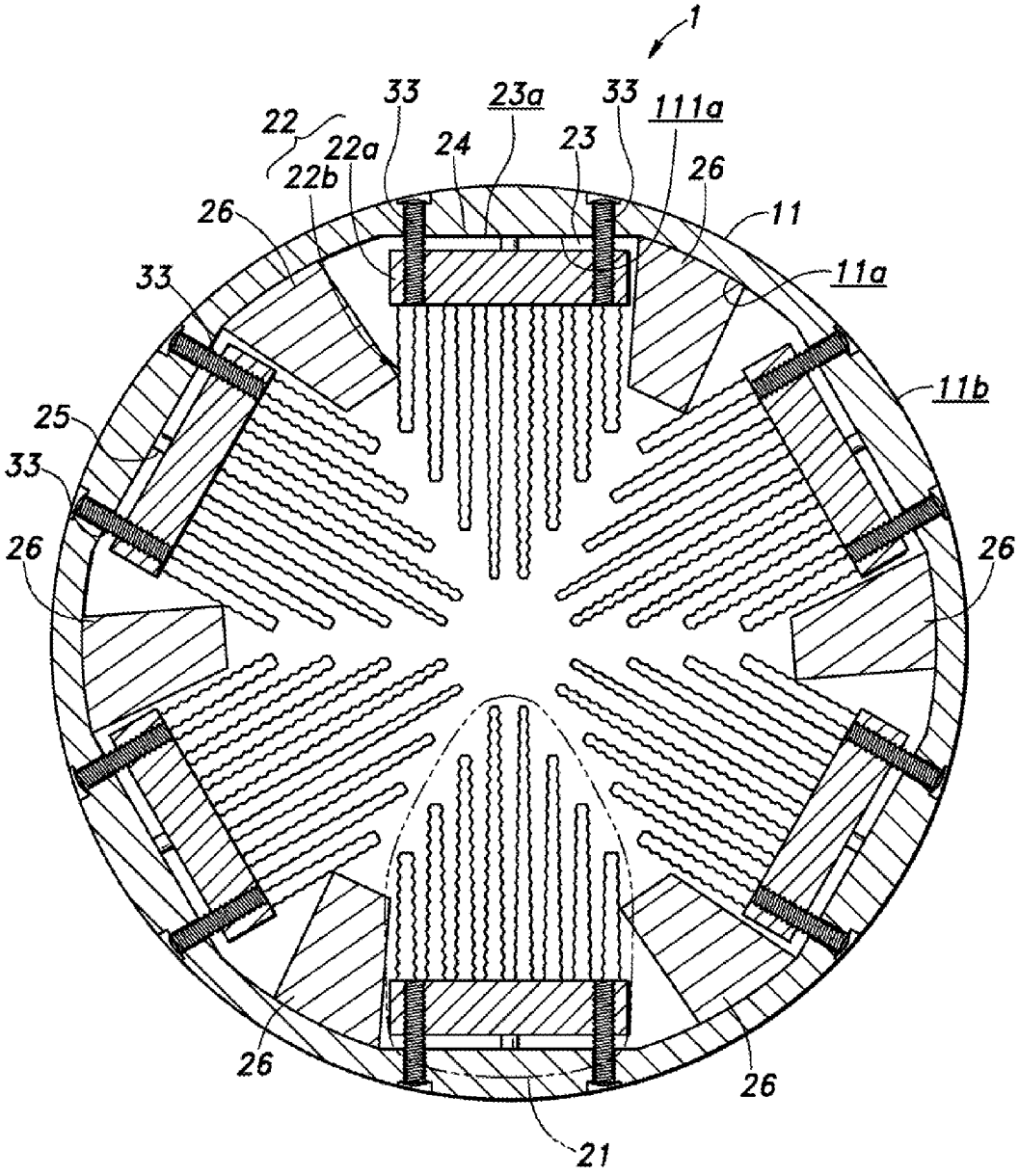
Figure 9:
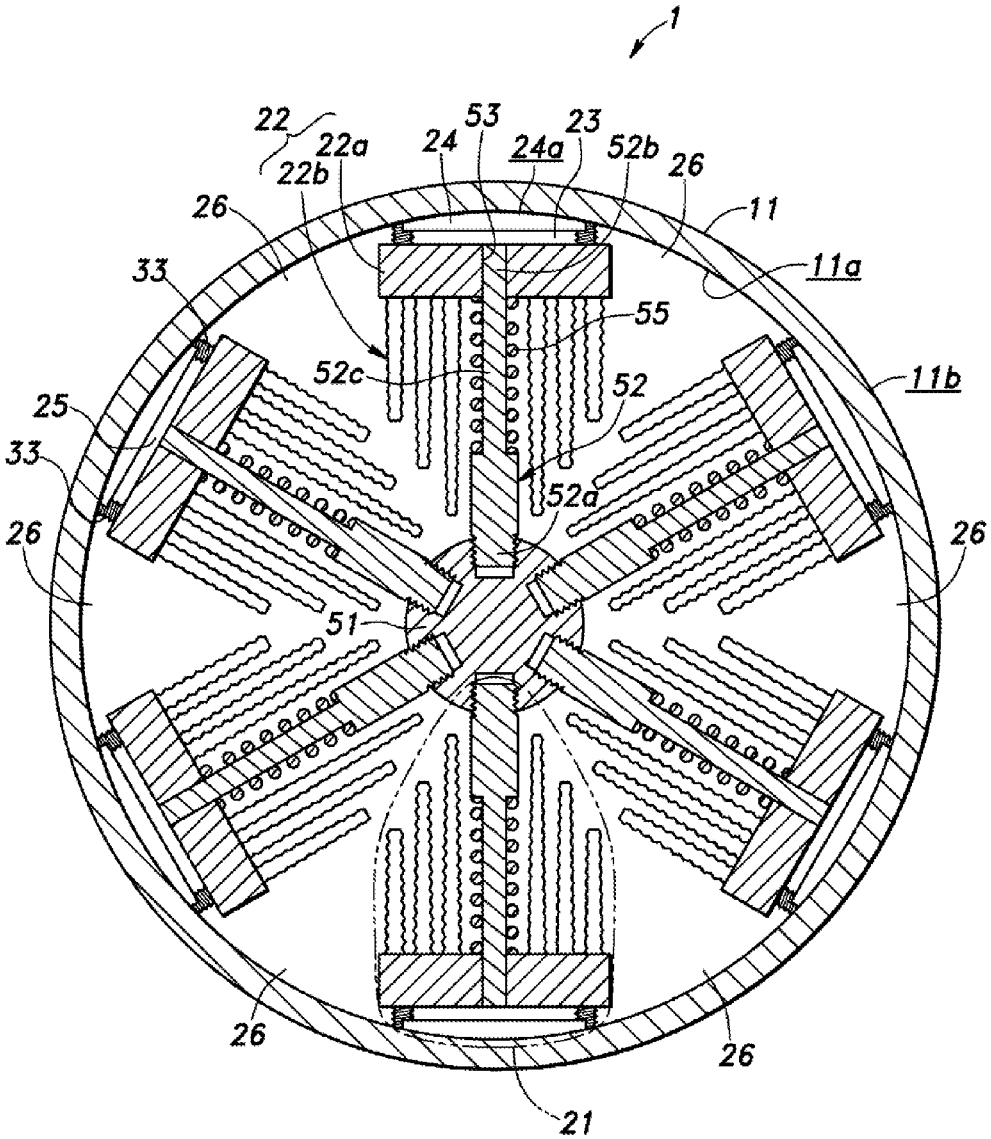

FIG, 7 is an enlarged cross-sectional view of a main part at VII-VII line in FIG. 4 as viewed in a direction of arrows;

FIG. 8 is a view illustrating an internal structure of a printing sheet cooling device ding to a second. exemplary embodiment; and FIG. 9 is a view illustrating an internal structure of a printing sheet cooling device according to a third exemplary embodiment.

DETAILED DESCRIPTION OF THE PREFERRED EMBODIMENTS

According to a sheet material cooling device disclosed in Unexamined Japanese Patent Publication No. 5-301336, a roller includes an outer casing in contact with a printing sheet, and an inner casing provided inside the outer casing. A cooling unit (including a plurality of thermoelectric conversion elements in this reference) is disposed on an outer circumferential surface of the inner casing. The outer casing and the inner casing are coupled with each other in a state of close contact between the low temperature side of the thermoelectric conversion elements and an inner circumferential surface of the outer casing, and between the high temperature side of the thermoelectric conversion elements and the outer circumferential surface of the inner casing. Strip-shaped. fins extend from an inner surface of the inner casing toward a casing center to produce a supply fan for supplying airflow into the inner casing. This structure cools the roller during conveyance of the printing sheet by cooling the outer casing of the roller, thereby cooling the printing sheet in a high-temperature state caused by heating and drying after completion of front surface printing.

According to the foregoing sheet material cooling device, the front and rear surfaces of the thermoelectric conversion elements corresponding to one and the other electrodes are brought into tight contact with the outer casing and the inner casing in a mariner as follows. An inside diameter of the outer casing is reduced to a diameter smaller than an outside diameter of the inner casing at room temperature. The inner casing is inserted into the outer casing in a heated and expanded state of the outer casing. The outer casing is cooled to realize a state of tight contact between the outer casing and the inner casing. However, this method is difficult to determine whether or not sufficient contact has been produced by an appropriate load. Similar problem may be caused at the time of cooling for other sheet materials as well as a printing sheet. In addition, when an excessive load is applied to the thermoelectric conversion. elements included in the cooling unit in accordance with cooling of the outer casing, the thermoelectric conversion elements may be damaged. Accordingly, complicated manufacturing such as highly accurate dimension control for the outer casing and the inner casing is required.

The present disclosure has been developed to solve the above problems of the conventional technologies. The present disclosure provides a sheet material cooling device and a printer including the sheet material cooling device, capable of easily bringing a cooling surface of a cooling unit into tight contact with an inner circumferential surface of a cylindrical body such as a roller, thereby wing cooling performance for a sheet material in contact with an outer circumferential surface of the cylindrical body.

A sheet material cooling device according to a first disclosure developed to solve the above problems includes a cylindrical body having an outer circumferential surface to be in contact with a sheet material, a cooling unit having a cooling surface in contact with an inner circumferential surface of the cylindrical body, and a first fastening member inserted from an outside of the cylindrical body toward an inside to attach the cooling unit to the cylindrical body in a state that the cooling surface is in contact with the inner circumferential surface.

According to this structure, contact between the cooling surface of the cooling unit and the inner circumferential surface of the cylindrical body is made in such a manner that the cooling unit is pulled from the outside of the cylindrical body. In this case, the cooling surface of the cooling unit is easily brought into tight contact with the inner circumferential surface of the cylindrical body. Accordingly, cooling performance for the sheet material in contact with the outer circumferential surface of the cylindrical body improves.

According to a sheet material cooling device of a second disclosure, a conveyance area for conveying the sheet material of the sheet material cooling device of the first disclosure is defined in the outer circumferential surface of the cylindrical body. In this case, a first insertion hole for receiving the first fastening member is formed in an area of the outer circumferential surface of the cylindrical body other than the conveyance area.

According to this structure, the sheet material is cooled in a stable state without an effect of the first insertion hole through which the first fastening member is inserted.

According to a sheet material cooling device of a third disclosure, the cooling unit of the sheet material cooling device of the first disclosure includes a thermoelectric conversion unit having the cooling surface curved in a circular arc shape capable of contacting the inner circumferential surface of the cylindrical body, and a support body attached to the cylindrical body to support the thermoelectric conversion unit in a state that the thermoelectric conversion unit is sandwiched between the support body and the inner circumferential surface.

According to this structure, the thermoelectric conversion unit and the support body are handled in a combined state, therefore attachment of the thermoelectric conversion unit to the cylindrical body can be easily made. In addition, the cooling surface of the thermoelectric conversion unit has a curved shape in correspondence with the inner circumferential surface of the cylindrical body. In this case, the cooling surface of the thermoelectric conversion unit more securely comes into tight contact with the inner circumferential surface of the cylindrical body by attachment of the support body to the cylindrical body. Accordingly, cooling performance improves.

According to a sheet material cooling device of a fourth disclosure, the thermoelectric conversion unit of the sheet material cooling device of the third disclosure is supported by the support body in a manner that the thermoelectric conversion unit is movable in a direction crossing a radial direction of the cylindrical body in a state that the cooling surface is in contact with the inner circumferential surface.

According to this structure, the thermoelectric conversion unit is displaceable in the direction crossing the radial direction of the cylindrical body (generally horizontal direction). In this case, the cooling surface of the thermoelectric conversion unit more securely comes into tight contact with the inner circumferential surface of the cylindrical body even when slight positional deviation. is produced at the time of attachment of the support body to the cylindrical body. Accordingly, cooling performance improves.

According to a sheet material cooling device of a fifth disclosure, the thermoelectric conversion unit of the sheet material cooling device of the fourth disclosure is attached to the support body by a second fastening member in a manner that the movable range is limitable.

According to this structure, the movable range of the thermoelectric conversion unit is appropriately limitable. In this case, the cooling surface of the thermoelectric conversion unit more securely comes into tight contact with the inner circumferential surface of the cylindrical body by attachment of the support body to the cylindrical body. Accordingly, cooling performance improves.

According to a sheet material cooling device of a sixth disclosure, the thermoelectric conversion unit of the sheet material cooling device of the fifth disclosure includes a second insertion hole having a diameter larger than a diameter of the second fastening member to allow insertion of the second fastening member through the second insertion hole. In this case, the second fastening member is an assembly screw that includes a screw portion screwed into the support body, a shaft portion having a diameter larger than a diameter of the screw portion and smaller than the diameter of the second insertion hole, and a head portion having a diameter larger than the diameter of the second insertion hole.

According to this structure, a shoulder surface produced by a step formed by the shaft portion and the screw portion is brought into contact with the support body by screwing the assembly screw into the support body. In this case, the thermoelectric conversion unit is attachable to the support body without separation by using the head portion of the assembly screw vertically fixed to the support body as a result of the contact between the shoulder surface and the support body. Accordingly, such a structure capable of attaching the thermoelectric conversion unit to the support body with a predetermined degree of freedom but without separation is easily realizable, therefore the support body to which the thermoelectric conversion unit is attached as one body is easily attachable to the cylindrical body (conveyance body).

According to a sheet material cooling device of a seventh disclosure, the thermoelectric conversion unit of the sheet material. cooling device of the third disclosure includes a thermoelectric conversion module supported by the support body, and a cooling plate laminated on the thermoelectric conversion module and having the cooling surface.

According to this structure, the thermoelectric conversion module has a board shape and is easily manufacturable. Moreover, the cooling surface curved in a circular arc shape is only formed on the cooling plate provided separately from the thermoelectric module. In this case, processing of the curved surface to be aligned with the inner circumferential surface of the cylindrical body becomes easier and more accurate. Accordingly, tight contact between the inner circumferential surface of the cylindrical body and the cooling surface improves.

According to a sheet material cooling device of an eighth disclosure, the cooling surface of the sheet material cooling device of the first disclosure has a flat shape. In this case, the inner circumferential surface of the cylindrical body includes a flat area in contact with at least the cooling surface.

According to this structure, the flat cooling surface of the cooling unit is brought into tight contact with the flat area of the inner circumferential surface of the cylindrical body. This simplification m configuration improves cooling performance.

According to a sheet material cooling device of a ninth disclosure, the support body of the sheet material cooling device of the third disclosure is formed of a heat sink.

According to this structure, the support body for supporting the thermoelectric conversion unit is configured by the heat sink. In this case, the necessity for using a support body dedicated. for attaching the thermoelectric conversion unit to the cylindrical body is eliminated. Accordingly, complication of assembly is avoidable.

According to a sheet material cooling device of a tenth disclosure, a plurality of the heat sinks of the sheet material cooling device of the ninth disclosure are arranged in a circumferential direction of the inner circumferential surface. In this case, a spacer extending in an axial direction of the cylindrical body is interposed between the heat sinks adjacent to each other.

When the plurality of heat sinks are arranged on the inner circumferential surface of the cylindrical body in the circumferential direction, a space is produced between the heat sinks adjacent to each other to avoid interference between the adjoining heat sinks. When air flows through the space, decrease in radiation of the heat sink is prevented due to decrease in the flow amount of air flowing toward the heat sinks. However, the spacer provided in this structure prevents airflow toward the space, thereby considerably increasing the amount of air flowing through the radiation fins.

According to a sheet material cooling device of an eleventh disclosure, the heat sink of the sheet material cooling device of the eighth disclosure includes radiation fins extending toward a shaft center of the cylindrical body. In this case, the radiation fins form a V shape tapered toward the shaft center as viewed in the axial direction of the cylindrical body.

According to this structure, a printing sheet (sheet material) heated and dried for drying ink at the time of surface printing is cooled to a temperature appropriate for printing prior to rear surface printing to secure quality of the rear surface printing performed after the front surface printing on the printing sheet at the time of duplex printing.

A sheet material cooling device of a twelfth disclosure includes, in addition to the sheet material cooling device of the third disclosure, a center shaft positioned at a shaft center of the cylindrical body, a support shaft of which first end is connected with the center shaft, and a second end thereof is connected with the support body, and an urging unit wound around the support shaft to urge the support body against the inner circumferential surface of the cylindrical body.

According to this structure, adhesion between the inner circumferential surface of the cylindrical body and the thermoelectric conversion unit is maintained without an effect of an axial length of a roller.

A printer according to a thirteenth disclosure performs printing on a front surface and a rear surface of a sheet material. The printer includes a front surface printing device that performs printing on the front surface of the sheet mater heating device that heats and dries the sheet material, and a rear surface printing device that performs printing on the rear surface of the sheet material. The front surface printing device, the heating device, and the rear surface printing device are disposed in this order on a conveyance path for conveying the sheet material. The sheet material cooling device of the first disclosure is disposed on the conveyance path between the heating device and the rear surface printing device.

According to this structure, a printing sheet (sheet material) heated and dried for drying ink at the time of surface printing is cooled to a temperature appropriate for printing prior to rear surface printing to secure quality of the rear surface printing performed after the front surface printing on the printing sheet at the time of duplex printing.

Exemplary embodiments according to the present disclosure are hereinafter described with reference to the drawings.

First Exemplary Embodiment

Figure 1:
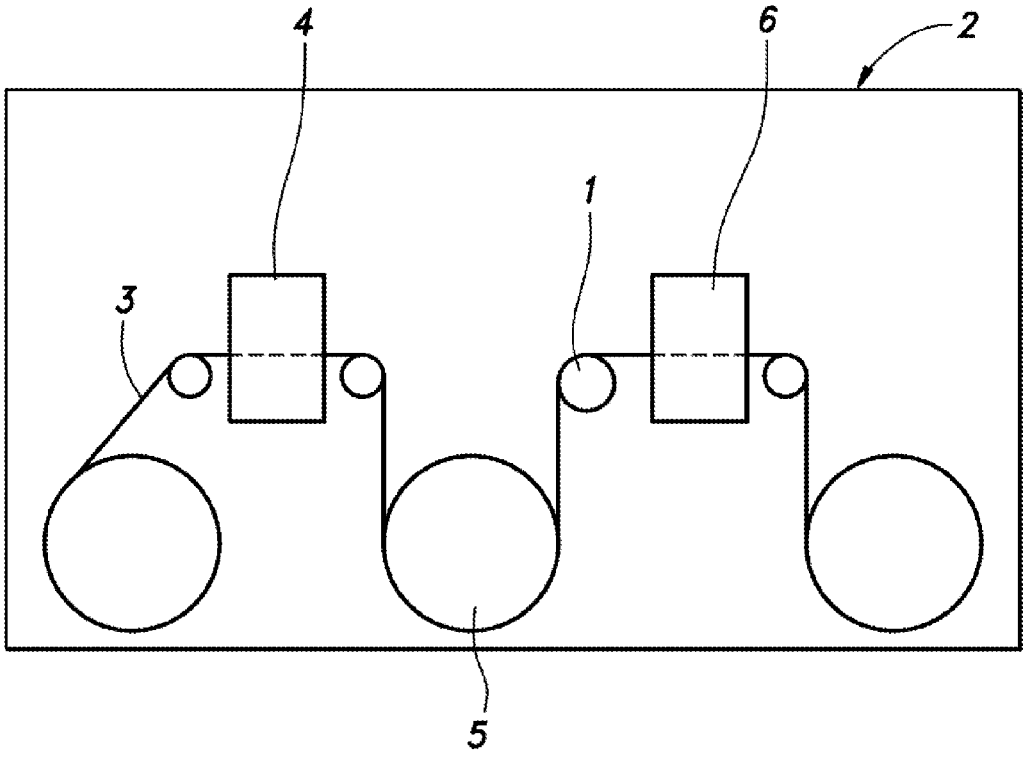
FIG. 1 is a schematic side view illustrating an example of a printer according to a first exemplary embodiment.

FIG. 1 is a schematic side view illustrating an example of a printer according to a first exemplary embodiment of the present disclosure. Printer 2 illustrated in the figure is an example of an industrial printer. Printer 2 includes front surface printing device 4 disposed on a conveyance path for conveying printing sheet (sheet material) 3 constituted by a strip-shaped printing sheet and, drawn from a paper roll. Front surface printing device 4 initially performs printing on a front surface of printing sheet 3. Disposed next are drier 5 for heating and drying ink on printing sheet 3 after front surface printing, printing sheet cooling device (sheet material cooling device) 1 for cooling heated and dried printing sheet 3 to a temperature appropriate for ink application for rear surface printing, and rear surface printing device 6 for performing rear surface printing on a rear surface of printing sheet 3. Drier 5, printing sheet cooling device 1, and rear surface printing device 6 are positioned in this order. Printer 2 according to the present disclosure may be an arbitrary printer as long as printing sheet cooling device 1 is disposed on a conveyance path for conveying printing sheet 3 after front surface printing to a position of subsequent rear surface printing. Accordingly, printer 2 of the present disclosure is riot limited to the example specifically described in this exemplary embodiment including the conveyance path for printing sheet 3.

Figure 2:
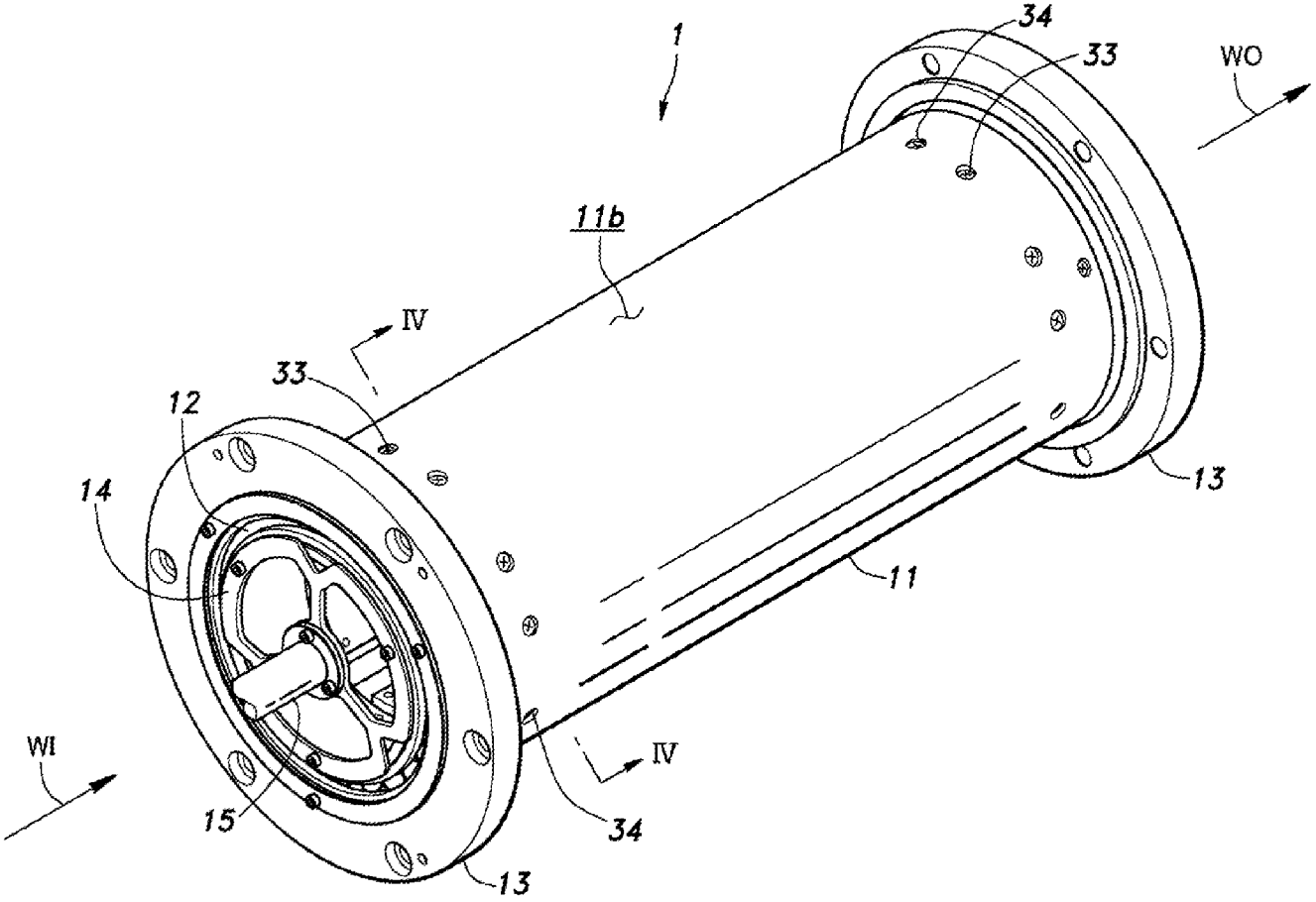
FIG. 2 is a general perspective view illustrating an external appearance of a printing sheet cooling device according to the first exemplary embodiment.
Figure 3:
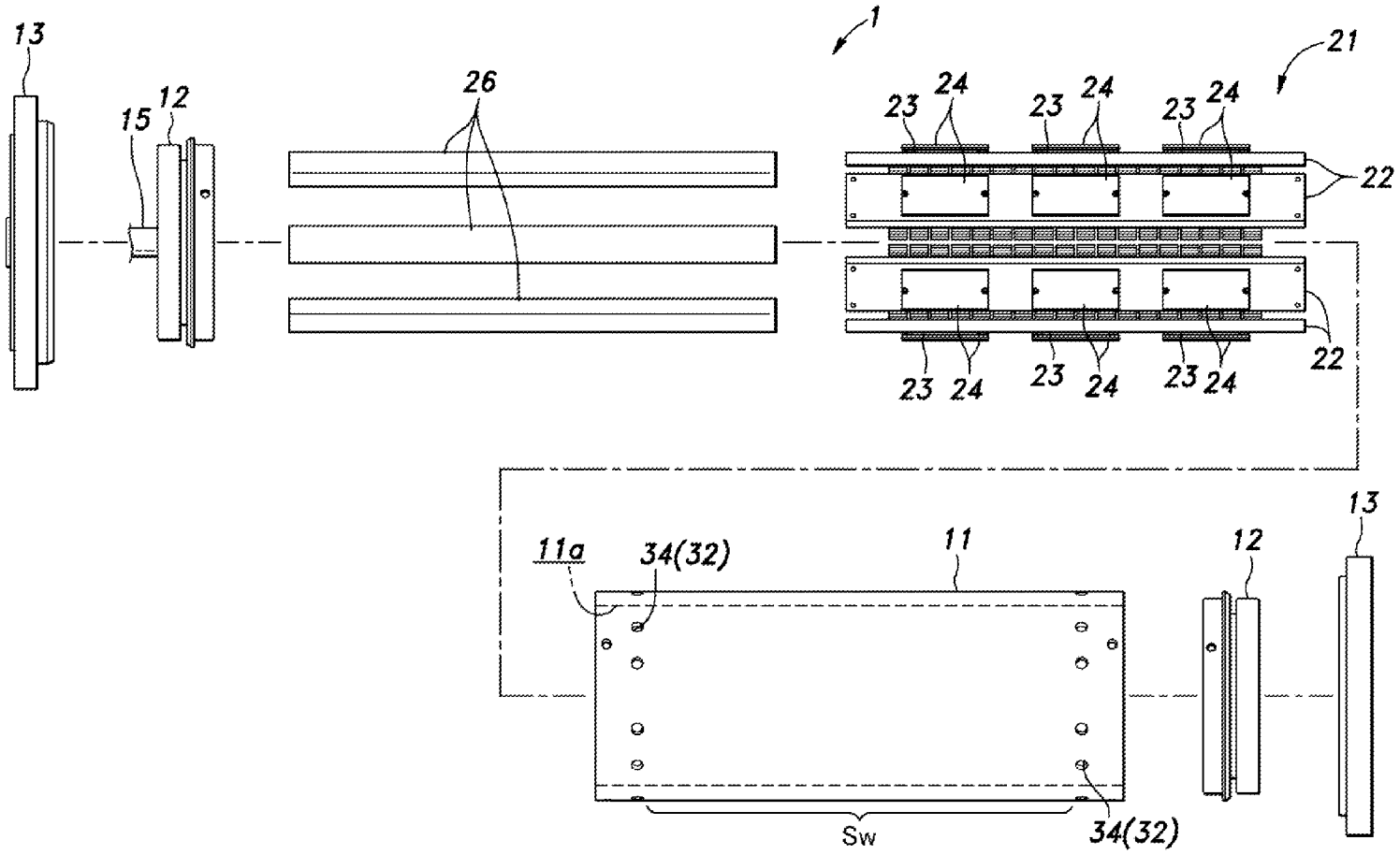
FIG. 3 is an exploded side view of the printing sheet cooling device according to the first exemplary embodiment.

FIG. 2 is a general perspective view illustrating an external appearance of printing sheet cooling device 1 according to the first exemplary embodiment. FIG. 3 is an exploded side view of printing sheet cooling device 1. FIG. 4 is a view illustrating an internal structure at IV-IV line in FIG. 2 as viewed in a direction of arrows of IV-IV line. As illustrated in FIGS. 2 through 4, printing sheet cooling device 1 includes roller 11 having a thin cylindrical shape forming a cylindrical, body, a pair of left and right bearings 12 coaxially disposed. to support both axial ends of roller 11 such that roller 11 is freely rotatable, and attachment rings 13 each of which supports an outer ring of corresponding bearing 12. Each of the axial ends of cylindrical roller 11 is coaxially connected with an inner ring of corresponding bearing 12. Each of attachment rings 13 is connected with the outer ring of corresponding bearing 12. Attachment rings 13 are fixed to a not-shown frame of printer 2.

Annular junction plate 14 is attached to the inner ring of left bearing 12 in the figure. Shaft 15 is connected with junction plate 14. A shaft of a slip ring (not shown) is connected with shaft 15 via a coupling. This slip ring supplies power to thermoelectric conversion modules housed in the rotating roller. Roller 11 is rotated in accordance with conveyance of printing sheet 3. Roller 11 is made of aluminum alloy or the like.

As illustrated in FIG. 4, a plurality of (six in the figure) cooling units 21 are provided inside roller 11. Cooling units 21 have identical shape and structure with each other. As illustrated in FIG. 4 in conjunction with an exploded perspective view of FIG. 5, each of cooling units 21 includes heat sink 22 attached to inner circumferential surface 11*a* of roller 11, thermoelectric conversion modules 23 provided on the inner circumferential surface 11*a* side of heat sink 22, and cooling plates 24 laminated outside of thermoelectric conversion modules 23.

Each of cooling plates 24 is made of material having high heat conductivity, and includes flat lower surface 24*e* disposed in surface contact with cooling surface 23*a* of corresponding thermoelectric conversion module 23, and upper surface (cooling surface) 24*a* curved in a circular-arc shape complementary to inner circumferential surface 11*a*. Accordingly, each of cooling plates 24 forms a cylindrical lens shape on the whole. According to this exemplary embodiment, thermoelectric modules 23 and cooling plates 24 configure a thermoelectric conversion unit. Accordingly, upper surfaces 24*a* of cooling plates 24 correspond to a cooling surface of the thermoelectric conversion unit. Cooling plates 24 may be eliminated. In this case, a surface of a casing forming cooling surface 23*a* of each thermoelectric conversion module 23 may have a shape curved in a circular-arc shape corresponding to in circumferential surface 11*a*. In this case, thermoelectric conversion modules 23 correspond to the thermoelectric conversion unit.

Discussed in this exemplary embodiment is an example applied to roller 11 rotated by printing sheet 3. However, this exemplary embodiment is applicable to a roller which conveys printing sheet 3. This exemplary embodiment is further applicable to a cylinder configured by a cylindrical body fixed and not rotatable.

The sheet material cooling device to which the present disclosure is applicable is not limited to a device for cooling a printing sheet (i.e., printing sheet cooling device), but may be a device for cooling an arbitrary sheet material. Examples of the sheet material include not only a material which constantly has a sheet shape, such as paper and a resin sheet, but also a material temporarily changeable into a sheet material (such as materials in a manufacturing step for industrial products and foods). When a plurality of rollers 11 are equipped as conveyance rollers of a belt conveyor, the material to be conveyed is not limited to a sheet material, but may be a material having a three-dimensional shape.

Heat sink 22 includes long and rectangular plate-shaped heat sink body 22*a* corresponding to a support body, and a plurality of lines of radiation fins 22*b* extending in parallel with each other and vertically from an inside surface of heat sink body 22*a* (on the side opposite to the side where thermoelectric modules 23 are disposed). Heat sink body 22*a* and radiation fins 22*b* are formed. integrally with each other. Radiation fins 22*b* are configured by a plurality of wall-shaped pieces extended in a longer direction of heat sink body 22*a* (axial direction of roller 11 perpendicular to sheet surface of FIG. 4), and arranged with clearances left between each other in a shorter direction. of heat sink body 22*a*. Support surface 22*c* formed on an outside of heat sink body 22*a* (on the side where thermoelectric conversion modules 23 are disposed) has a flat surface such that radiation surfaces of rectangular board-shaped thermoelectric conversion modules 23 can be positioned in surface contact with support surface 22*c*.

Heat sink 22 having this configuration is formed by extrusion molding, for example. A length of heat sink body 22*a* in the longer direction is shorter than a length of roller 11 in the axial direction. However, these lengths are substantially equivalent.

Each of thermoelectric conversion modules 23 includes a plurality of rectangular parallelepiped thermoelectric conversion elements arranged along a plurality of lengthwise and crosswise lines within a rectangular board-shaped case. Either a front surface or a rear surface of thermoelectric conversion module 23, each surface of which is formed by a flat surface extending in the arrangement direction of the thermoelectric conversion elements, corresponds to a cooling surface, while the other surface corresponds to a radiation surface. Each of thermoelectric conversion modules 23 may be configured by a known structure which includes thermoelectric conversion elements constituted by P-type semiconductors, and thermoelectric conversion elements constituted by N-type semiconductors, as two types of thermoelectric conversion elements alternately disposed and connected in series. These thermoelectric conversion elements are not detailed herein. Similarly, other parts such as external wiring of leads for positive and negative electrodes may be constituted by known structures (such as structure for energization via slip ring). These structures are not depicted in the figures.

According to each of cooling units 21 in this exemplary embodiment, three thermoelectric modules 23 are provided on. one heat sink 22. The number of thermoelectric conversion modules 23 may be an arbitrary number in correspondence with a length of roller 11 in the axial direction, i.e., a length of heat sink 22 in the longer direction, and a unit size of single thermoelectric conversion module 23. Accordingly, the number of thermoelectric conversion modules 23 is not limited to three as in the example illustrated in the figure.

Each of cooling plates 24 has a rectangular shape in a size sufficient for completely covering cooling surface 23*a* of corresponding thermoelectric conversion module 23 in the plan view. Screw insertion hole (second insertion hole) 24*b* (see FIG. 6A) is formed at a center of each end of cooling plate 24 in the longer direction (longer direction of heat sink body 22*a*). Screw insertion hole 24*b* penetrates cooling plate 24 in a plate thickness direction. Screw hole 22*d* is formed at a position of heat sink body 22*a* corresponding to each screw insertion hole 24*b* of cooling plates 24 disposed at predetermined positions.

Thermoelectric conversion modules 23 are positioned on support surface 22*c* of heat sink body 22*a* in a state that the radiation surfaces face support surface 22*c*, while cooling plates 24 are positioned on cooling surfaces 23*a* corresponding to upper surfaces of thermoelectric conversion modules 23. As a result, thermoelectric conversion modules 23 and cooling plates 24 are laminated in this order in the direction from the inside to the outside. Assembly screw (second fastening member) 25 is inserted through each of screw insertion holes 24*b*, and screwed into corresponding screw hole 22*d* to attach thermoelectric conversion modules 23 and cooling plates 24 to heat sink body 22*a* into one body. After this attachment, thermoelectric conversion modules 23 and heat sink 22 are handled as an integrated unit of cooling unit 21.

In a state of attachment between cooling units 21 and roller 11, a space having a triangular cross section as viewed in the axial direction of roller 11 is produced between each adjoining pair of cooling units 21 in a circumferential direction. Spacer 26 having a triangular prism shape and extending in the axial direction of roller 11 is provided in each of these spaces. Each of heat sink bodies 22*a* has a board shape having a rectangular cross section, therefore each of spacers 26 is fitted between opposed side surfaces of adjoining heat sink bodies 22*a* in the circumferential direction of roller 11, and assembled inside roller 11 in a state that separation toward the inside in a radial direction of roller 11 is regulated. Displacement in the axial direction of roller 11 is regulated by both bearings 12.

Figure 6A:
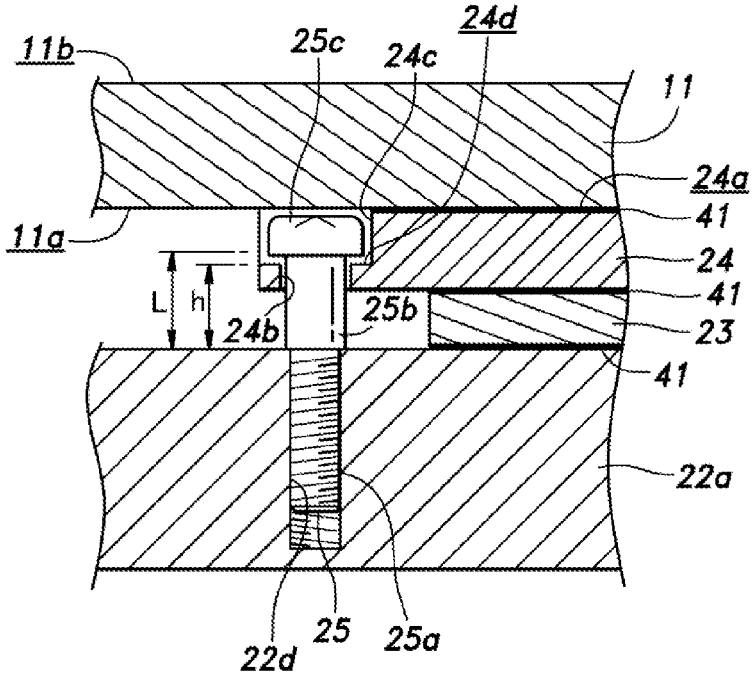
FIG. 6A is an enlarged cross-sectional view of a main part at VI-VI line in FIG. 4 as viewed in a direction of arrows.
Figure 6B:
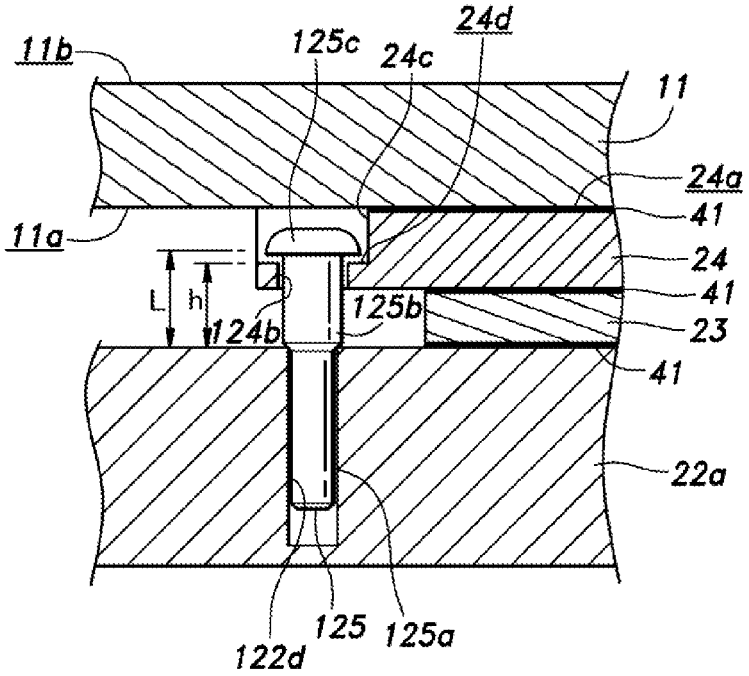
FIG. 6B is an enlarged cross-sectional view of a main part of a modified example of FIG. 6A.

FIG. 6A is an enlarged cross-sectional view of a main part taken along a line VI-VI in FIG. 4 and viewed in a direction of arrows. while FIG. 6B is a view illustrating a modified example of FIG. 6A. As illustrated in FIG. 6A, assembly screw 25 has a flat and small screw shape including small-radius screw portion 25*a* constituted by a male screw in correspondence with screw hole 22*d*, shaft portion 25*b* having an expanded diameter and coaxially extending from one side of screw portion 25*a* and head portion 25*c* having an expanded diameter and a large-diameter disk shape and disposed on the side of shaft portion 25*b* opposite to screw portion 25*a*.

Cooling plate 24 has recess 24*c* opened to upper surface 24*a* in such shape as to receive and embed head portion 25*c*. An axial length L of shaft portion 25*b* is larger than a length h, which is the sum of a thickness of thermoelectric conversion module 23 and a thickness of a portion forming bottom surface 24*d* of recess 24*c* in cooling plate 24. The diameter of screw insertion hole 24*b* is larger than the diameter of shaft portion 25*b* by a predetermined length, while the diameter of recess 24*c* is larger than the diameter of head portion 25*c* by a predetermined length.

Accordingly, assembly screw 25 is screwed into screw hole 22*d*. until. contact between support surface 22*c* and a shoulder surface produced by a step formed by shaft portion 25*b* and screw portion 25*a*. As a result, assembly screw 25 is vertically fixed to heat sink body 22*a*. In this fixing state, clearances are produced between a lower surface of head portion 25*c* in a received state and bottom surface 24*d* in recess 24*c*, and clearances are produced between an outer circumferential surface of shaft portion 25*b* and an inner circumferential surface of screw insertion hole 24*b*. In this condition, cooling plate 24 (thermoelectric conversion unit) attached to heat sink body 22*a* is displaceable by a predetermined amount with respect to heat sink body 22*a* in the up-down and left-right directions. Accordingly, upper surface 24*a* (cooling surface) of cooling plate 24 is more securely brought into tight contact with inner circumferential surface 11*a* of roller 11 even when slight positional deviation is produced at the time of attachment of heat sink 22 to roller 11. As a result, cooling performance improves. Inn this case, the up-down direction corresponds to an axial. direction of assembly screw 25, while the left-right direction corresponds to a radial direction of assembly screw 25.

According to cooling unit 21, pin (second fastening member) 125 illustrated in FIG. GB may be employed in place of assembly screw 25 illustrated in FIG. 6A. Similarly to assembly screw 25, pin 125 includes small-diameter portion 125*a* corresponding to pin hole 122*d*, shaft portion 125*b* having an expanded diameter and coaxially extending from one side of small-diameter portion 125*a*, and head portion 125*c* having an expanded diameter and a large-diameter disk shape and disposed on the side of shaft portion 125*b* opposite to small-diameter portion 125*a*. Pin 125 may have a uniform diameter throughout a length of pin 125 in the longer direction (i.e., may be formed by using a rod having the same diameter for shaft portion 125*b* and head portion 125*c* as the diameter of small-diameter portion 125*a*). This configuration is applicable to assembly screw 25 as well. Alternatively, the diameters of small-diameter portion 125*a* and shaft portion 125*b* may be made equivalent, while the diameter of head portion 125*c* may be made smaller than the diameter of small-diameter portion 125*a* and shaft portion 125*b*.

Cooling units 21, each of which includes thermoelectric conversion modules 23 and cooling plates 24 in the state of attachment to heat sink 22 into one body, are arranged inside roller 11 in six lines at equal angle intervals in the circumferential direction according to the example illustrated in the figure. As illustrated in FIG. 4 viewed in the axial direction of roller 11, heat sink bodies 22*a* are positioned on the inner circumferential surface 11*a* side of roller 11 while radiation fins 22*b* are extended from heat sink bodies 22*a* toward a shaft center of roller 11. Accordingly, respective radiation fins 22*b* approach each other in the direction toward the shaft center of roller 11, forming a sharp V shape tapered toward the shaft center of roller 11 as viewed in the axial direction of roller 11. Each of the plurality of lines of wall-shaped. pieces forming radiation fins 22*b* is divided into a plurality of rectangular pieces linearly continuing with slit-shaped clearances formed at a plurality of positions in the longer direction of heat sink body 22*a*. Wall surfaces of the respective wall-shaped pieces of radiation fins 22*h* form a wavy shape having a plurality of lines extending in the longer direction of heat sink body 22*a*.

Figure 7:
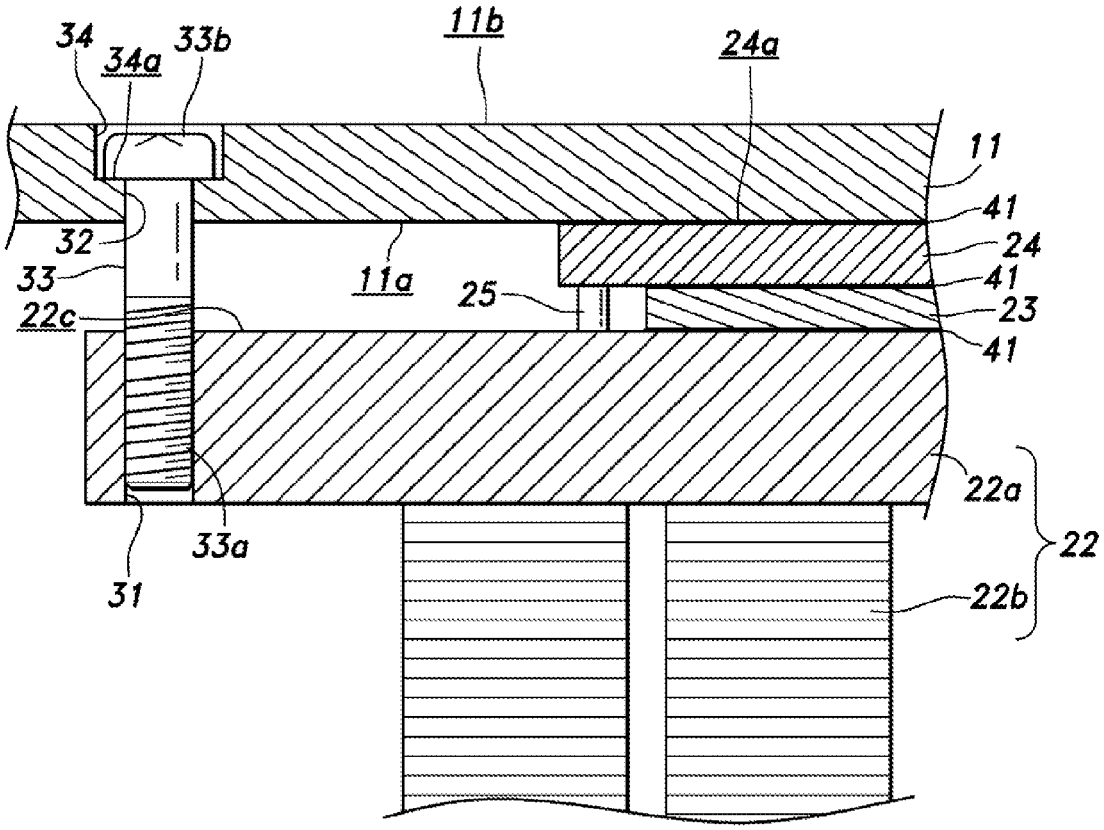

A structure for attaching cooling units 21 to roller 11 is hereinafter described. FIG. 7 is an enlarged cross-sectional view of a main part taken along a line in FIG. 4 as viewed in a direction of arrows. Screw hole 31 is provided in the vicinity of each of four corners of a rectangular shape forming an external appearance of heat sink body 22*a*. Screw insertion hole (first insertion hole) 32 is formed in roller 11 at a position corresponding to each of screw holes 31. Each of screw holes 31 is aligned with corresponding screw insertion hole 32 when respective cooling units 21 are positioned as described above. Fixing screws (first fastening members) 33 are inserted through screw insertion holes 32 and screwed into screw holes 31.

Each of fixing screws 33 has a flat small screw shape including screw portion 33*a* constituting a male screw and having a predetermined diameter, and disk-shaped head portion 33*b* having a disk shape and a larger diameter than the diameter of screw portion 33*a*. Disk-shaped recess 34 is coaxially formed in screw insertion hole 32 on the outer circumferential surface 11*b* side of roller 11. Recess 34 surrounds an outer circumference of head portion 33*b* with substantially no clearance produced between recess 34 and head portion 33*b*, and receives and embeds head portion 33*b*. An annular portion of a bottom of recess 34 for surrounding screw insertion hole 32 is formed as locking surface 34*a* forming a flat surface perpendicular to an axial line of screw insertion hole 32. As illustrated in FIG. 3, respective recesses 34 (respective screw insertion holes 32) are disposed in outer circumferential surface 11*b* of roller 11 in an area (both sides in width direction.) other than a conveyance area Sw for a printing sheet.

When fixing screw 33 is inserted into screw hole 31 in a state of contact between head portion 33*b* and locking surface 34*a*, a distance between inner circumferential surface 11*a* of roller 11 and support surface 22*c* of heat sink body 22*a* decreases. Accordingly, pressing force applied to thermoelectric conversion modules 23 and cooling plates 24 sandwiched between roller 11 and heat sink body 22*a*, i.e., each adhesion between support portion 22*c* and thermoelectric conversion modules 23, between thermoelectric modules 23 and cooling plates 24, and between cooling plates 24 and inner circumferential surface 11*a* is adjustable by increasing or decreasing a screwing amount of fixing screw 33 into screw hole 31. This adhesion may be adjusted by using a spring wound around assembly screw 25 provided between inner circumferential surface 11*a* of roller 11 and support surface 22*c* of heat sink 22.

Heat conductive grease 41 having high heat conductivity is filled between heat sink body 22*a*, thermoelectric conversion modules 23, cooling plates 24, and roller 11. In this case, distances between respective components in separating directions are adjustable within a range of filling thickness, therefore processing errors in flatness of the respective components are absorbable. The adhesion may be adjusted by torque control of fixing screw 33, for example. In addition, fastening of fixing screw 33 is adjustable while measuring a temperature of outer circumferential surface 11*b* in an energized state.

A plurality of cooling units 21 attached to roller 11 in this manner are arranged at equal angle intervals for six equal divisions, for example, in the circumferential direction as illustrated in the example in the figure. In this case, the adhesion is adjustable for each of cooling units 21. Accordingly, equalization of cooling characteristics and improvement of cooling efficiency of thermoelectric conversion modules 23 provided throughout inner circumferential surface 11*a* of roller 11 are easily realizable.

On the other hand, in case of a structure where an outer circumferential surface of a cylindrical heat sink body comes into tight contact with inner circumferential surface 11*a* of roller 11 as in a conventional example, shaft centers of the cylindrical heat sink body and roller 11 may deviate from each other after adjustment by screwing into roller 11 in the radial direction. In this case, the entire structure is difficult to adjust at uniform intervals. When a double pipe stationary fit structure is adopted for overcoming this problem, highly accurate processing for an inner pipe and an outer pipe is required. In addition, fine adjustment is difficult in this structure, therefore designed cooling characteristics are difficult to achieve at the time of excessively small or large adhesion.

On the other hand, when fastening force is adjusted using fixing screws 33 for each of a plurality of cooling units 21 provided in the circumferential direction of roller 11 as in the exemplary embodiment of the present disclosure, the adhesion is adjustable for each of cooling units 21. In this case, appropriate adhesion is securable for each of cooling units 21, therefore cooling characteristics of each of thermoelectric conversion modules 23 come into an optimal state. Accordingly, the overall cooling efficiency can improve. Moreover, this structure allows handling of cooling units 21 by a small unit (per unit), thereby facilitating attachment and adjustment of cooling units 21. Accordingly, maintenance and replacement of cooling units 21 become easier.

As described with reference to FIG. cooling device 1 is provided in the course of the conveyance path from drier 5 to rear surface printing device 6 to cool printing sheet 3 heated and dried. by drier 5 after front surface printing before printing sheet 3 reaches the position of rear surface printing. Cooling device 1 according to this exemplary embodiment includes roller 11 having the foregoing configuration, and a blower (not shown) which supplies cooling air to an interior of roller 11 in a direction from an opening at one axial end of roller 11 toward the other end as indicated by an arrow W1 in FIG. 2.

Figure 5:
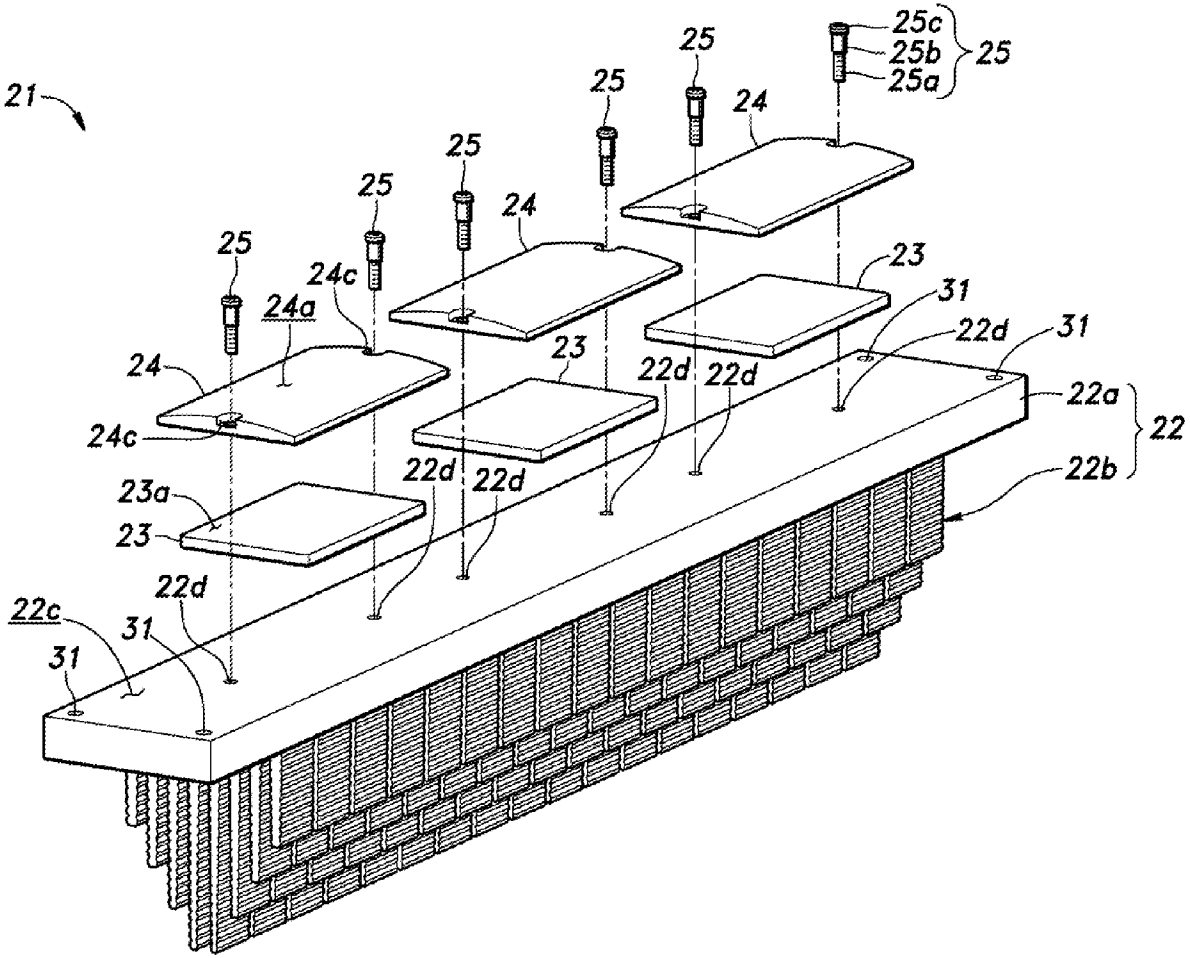
FIG. 5 is an exploded perspective view of a cooling unit according to the first exemplary embodiment.

The cooling air supplied to the interior of roller 11 is discharged through an opening at the other axial end of roller 11 as indicated by an arrow WO in the figure to flow through the interior of roller 11 in the axial direction. As illustrated in FIGS. 4 and 5, radiation fins 22*b* including the wall surfaces extending in the axial direction of roller 11 are provided inside roller 11. Accordingly, the cooling air smoothly flows without interference with radiation fins 22*b*, therefore cooling performance of radiation fins 22*b* improves.

As described above, each of the wall surfaces of radiation fins 22*b* has a wavy shape formed. by a number of lines extending in the axial direction. In this case, contact areas between radiation fins 22*b* and the cooling air increase. Moreover, triangular-prism-shaped spacers 26 are provided between respective cooling units 21 in a state that a vertical angle of each triangle faces the shaft center of roller 11. Accordingly, even when a space is produced between each adjoining pair of heat sinks 22 in a polygonal arrangement of board-shaped heat sink bodies 22*a* on inner circumferential surface 11*a* as viewed in the axial direction, this space is closed by spacer 26. Moreover, when the vertical angle side of each of triangular-prism-shaped spacers 26 is positioned between adjoining heat sinks 22, cooling air flowing between respective heat sinks 22 is directed toward radiation fins 22*b*. In this case, heat radiation of heat sinks 22, i.e., cooling performance of cooling units 21 further improves.

As described above a considerable amount of heat conducted from radiation surfaces of thermoelectric conversion modules 23 to heat sink bodies 22*a* is radiated via radiation fins 22*b*, therefore cooling performance of thermoelectric conversion modules 23 via cooling surfaces 23*a* increases. Accordingly, necessary cooling performance is offered even when the number of thermoelectric conversion elements is small, i.e., when thermoelectric conversion modules 23 are small-sized. This advantage contributes to size reduction of cooling device 1 based on miniaturization of cooling units 21, and to energy saving based on reduction of power consumption.

Second Exemplary Embodiment

FIG. 8 illustrates an internal structure of a printing sheet cooling device according to a second exemplary embodiment of the present disclosure, as a figure substantially in correspondence with FIG. 4 according to the first exemplary embodiment. Constituent elements in FIG. 8 similar to the corresponding constituent elements in the first exemplary embodiment discussed above have been given similar reference numbers. Matters not particularly touched upon in the following description of the printing sheet cooling device according to the second exemplary embodiment are similar to the corresponding matters according to the first exemplary embodiment.

According to printing sheet cooling device 1 in the second exemplary embodiment, cooling plates 24 in the first exemplary embodiment are formed integrally with roller 11. More specifically, flat area 111*a* in contact with cooling surfaces 23*a* of thermoelectric conversion modules 23 is formed on inner circumferential surface 11*a* of roller 11. This structure further secures tight contact between flat area 11*a* on inner circumferential surface 11*a* of roller 11 and cooling surfaces 23*a* of thermoelectric conversion modules 23, thereby improving cooling performance.

A space is produced between each pair of adjoining cooling units 21 in the circumferential direction as viewed in the axial direction of roller 11. In this example, trapezoidal. spacer 26 extending in. the axial direction of roller 11 is provided in each space.

Third Exemplary Embodiment

FIG. 9 is a view illustrating an internal structure of a printing sheet cooling device according to a third exemplary embodiment of the present disclosure, as a figure substantially in correspondence with a cross-sectional view of printing sheet cooling device 1 (roller 11) illustrated FIG. 2 referred to above, and taken at an axial center position. Constituent elements in FIG. 9 similar to the corresponding constituent elements in the first exemplary embodiment discussed above have been given similar reference numbers. Matters not particularly touched upon in the following description of the printing sheet cooling device according to the third exemplary embodiment are similar to the corresponding matters according to the first exemplary embodiment.

According to the structure where fixing screws 33 are positioned at both ends of roller 11 as discussed in the first exemplary embodiment, adhesion between cooling plates 24 and inner circumferential surface 11*a* may decrease at a central portion (conveyance area Sw) of roller 11 corresponding to a portion not provided with fixing screws 33 when the length of roller 11 in the axial direction increases. For overcoming this drawback, printing sheet cooling device 1 according to the third exemplary embodiment includes a mechanism for pressing cooling units 21 from the inside toward inner circumferential surface 11*a* of roller 11.

More specifically, center shaft 51 coaxially positioned with shaft 15 (see FIG. 2) is inserted through roller 11. Moreover, one or a plurality of substantially cylindrical support shafts 52 extending from center shaft 51 toward. the radially outside are provided inside roller 11 for each of cooling units 21. Base end portion 52*a* of each of support shafts 52 is fixed to center shaft 51, while free end portion 52*b* of support shaft 52 is inserted into insertion hole 53 formed in each of heat sink bodies 22*a*. In this case, a plurality of lines of radiation fins 22*b* positioned inside each of heat sink bodies 22*a* are positioned on both sides of support shaft 52 such that support shaft 52 is sandwiched between radiation fins 22*b*. Spring attachment portion 52*c* is formed on the free end portion 52*b* side of support shaft 52. Spring attachment portion 52*c* has a reduced diameter to allow winding of compression spring 55 around spring attachment portion 52*c*, According to this structure, heat sink body 22*a* (lower surface) is urged toward the outside (inner circumferential surface 11*a* side of roller 11) by urging force of compression spring 55. An elastic body such as compression spring 55 is an example of an urging unit.

This structure further secures tight contact between upper surfaces 24*a* of cooling plates 24 and inner circumferential surface 11*a* on the central portion of roller 11. Moreover, support shafts 52 are positioned at least at the central portion of roller 11, therefore adhesion of cooling plates 24 to inner circumferential surface 11*a* of roller 11 improves throughout the area of inner circumferential surface 11*a*. While not shown in FIG. 9, spacers may be positioned between adjoining cooling units 21 in the circumferential direction similarly to the first exemplary embodiment.

As easily understood by those skilled in the art, the present disclosure is not limited to the preferred exemplary embodiments described herein, but may be modified in appropriate mariners without departing from the scope of the present disclosure. In addition, all the constituent elements included in the exemplary embodiments are not necessarily essential, but may be appropriately selected without departing from the scope of the present disclosure.

According to the foregoing exemplary embodiments, heat is conducted between thermoelectric conversion modules 23 and inner circumferential surface 11*a* via cooling plates 24. However, cooling surfaces 23*a* of thermoelectric conversion modules 23 may have curved surfaces having the same curvature as the curvature of inner circumferential surface 11*a*. In this case, complicated processes for manufacturing cooling plates 24 separately and attaching cooling plates 24 are eliminated.

For attachment of thermoelectric conversion modules 23 to heat sink body 22*a*, separation of cooling plates 24 in the axial direction is prevented by using head portions 25*c* of assembly screws 25. However, thermoelectric conversion modules 23 and cooling plates 24 are pressed against inner circumferential surface 11*a* by heat sink bodies 22*a* after attachment to roller 11. Accordingly, each of assembly screws 25 may have a bar shape having the same diameter for shaft portion 25*b* and head portion 25*c*. Even in this case, an integrated state between heat sink bodies 22*a*, thermoelectric conversion modules 23, and cooling plates 24 is retainable by adhesive force given from heat conductive grease 41. Alternatively, a C-ring may be used for preventing separation.

Respective cooling units 21 may function as heating units by reversing polarity of current applied to thermoelectric conversion modules 23.

What is claimed is:

1. A sheet material cooling device comprising:

a cylindrical body having an outer circumferential surface to be in contact with a sheet material;

a cooling unit having a cooling surface in contact with an inner circumferential surface of the cylindrical body; and a first fastening member inserted from an outside of the cylindrical body toward an inside to attach the cooling unit to the cylindrical body in a state that the cooling surface is in contact with the inner circumferential surface, wherein:

a first insertion hole for receiving the first fastening member is formed in the outer circumferential surface of the cylindrical body, the cooling unit includes:

a thermoelectric conversion unit having the cooling surface, and a support body attached to the cylindrical body to support the thermoelectric conversion unit in a state that the thermoelectric conversion unit is sandwiched between the support body and the inner circumferential surface, and the thermoelectric conversion unit is supported by the support body in a manner that the thermoelectric conversion unit is movable in a direction crossing a radial direction of the cylindrical body in a state that the cooling surface is in contact with the inner circumferential surface.

2. The sheet material cooling device according to claim 1, wherein a conveyance area for conveying the sheet material is defined in the outer circumferential surface of the cylindrical body, and the first insertion hole is formed in an area of the outer circumferential surface of the cylindrical body other than the conveyance area.

3. The sheet material cooling device according to claim 1, wherein the cooling surface is curved in a circular arc shape capable of contacting the inner circumferential surface of the cylindrical body.

4. The sheet material cooling device according to claim 1, wherein:

the cooling surface has a flat shape, and the inner circumferential surface of the cylindrical body includes a flat area in contact with at least the cooling surface.

5. The sheet material cooling device according to claim 1, wherein the thermoelectric conversion unit is attached to the support body by a second fastening member in a manner that the movable range is limitable.

6. The sheet material cooling device according to claim 5, wherein the thermoelectric conversion unit includes a second insertion hole having a diameter larger than a diameter of the second fastening member to allow insertion of the second fastening member through the second insertion hole, and the second fastening member is an assembly screw that includes a screw portion screwed into the support body, a shaft portion having a diameter larger than a diameter of the screw portion and smaller than the diameter of the second insertion hole, and a head portion having a diameter larger than the diameter of the second insertion hole.

7. The sheet material cooling device according to claim 1, wherein the thermoelectric conversion unit includes a thermoelectric conversion module supported by the support body, and a cooling plate laminated on the thermoelectric conversion module and having the cooling surface.

8. The sheet material cooling device according to claim 1, wherein the support body is formed of a heat sink.

9. The sheet material cooling device according to claim 8, wherein a plurality of the heat sinks are arranged in a circumferential direction of the inner circumferential surface, and a spacer extending in an axial direction of the cylindrical body is interposed between the heat sinks adjacent to each other.

10. The sheet material cooling device according to claim 8, wherein the heat sink includes radiation fins extending toward a shaft center of the cylindrical body, and the radiation fins form a V shape tapered toward the shaft center as viewed in the axial direction of the cylindrical body.

11. The sheet material cooling device according to claim 1, further comprising:

a center shaft positioned at a shaft center of the cylindrical body;

a support shaft of which first end is connected with the center shaft, and a second end thereof is connected with the support body; and an urging unit wound around the support shaft to urge the support body against the inner circumferential surface of the cylindrical body.

12. A printer that performs printing on a front surface and a rear surface of a sheet material, the printer comprising:

a front surface printing device that performs printing on the front surface of the sheet material, a heating device that heats and dries the sheet material, and a rear surface printing device that performs printing on the rear surface of the sheet material, wherein:

the front surface printing device, the heating device, and the rear surface printing device are disposed in this order on a conveyance path for conveying the sheet material; and the sheet material cooling device according to claim 1 is disposed on the conveyance path between the heating device and the rear surface printing device.

* * * * *